United States Patent [19]

Gladstein

[11] Patent Number: 4,515,195

[45] Date of Patent: May 7, 1985

[54] METHOD AND APPARATUS FOR SUPPORTING LOGS AND THE LIKE

[76] Inventor: Harvey Gladstein, 309 E. 49th St., New York, N.Y. 10017

[21] Appl. No.: 515,508

[22] Filed: Jul. 20, 1983

[51] Int. Cl.[3] ..... B27L 7/00

[52] U.S. Cl. ..... 144/366; 144/193 K; 248/172; 248/310; 248/519; 269/254 CS; 269/268

[58] Field of Search ..... 248/172, 310, 519, 539, 248/670; 269/203, 204, 254 CS, 268, 287; 144/193 R, 193 K, 366

[56] References Cited

U.S. PATENT DOCUMENTS

| | | | |
|---|---|---|---|
| 1,672,808 | 6/1928 | Hansel | 269/268 X |
| 2,517,332 | 8/1950 | Mitchell et al. | 248/519 |
| 2,689,701 | 9/1954 | Whitaker | 248/172 X |
| 2,713,471 | 7/1955 | Hirsch | 248/310 X |
| 3,008,618 | 11/1961 | Watts et al. | 248/310 X |
| 4,239,198 | 12/1980 | Trupp | 144/193 K |
| 4,326,703 | 4/1982 | Marley | 269/254 CS |

FOREIGN PATENT DOCUMENTS

| | | | |
|---|---|---|---|
| 486114 | 9/1952 | Canada | 269/254 CS |

*Primary Examiner*—W. D. Bray

*Attorney, Agent, or Firm*—Epstein & Edell

[57] ABSTRACT

A log or piece of cord wood is supported upright on a base member between two support members which are secured to the base member so that at least one support member is movable toward and away from the other. The base member is sufficiently large to permit a user to stand thereon to positionally stabilize the base member while a log is being split. The support members are prevented from moving inadvertently during splitting by various alternative means such as of frictionally engaging one or both support members in tracks, spring biasing the support members toward one another, positionally locking a movable support member or by detenting the support members in various positions. The support members have concave surfaces extending at least 90° around and sufficiently high so as to preclude movement of the log during splitting.

20 Claims, 7 Drawing Figures

FIG. 1
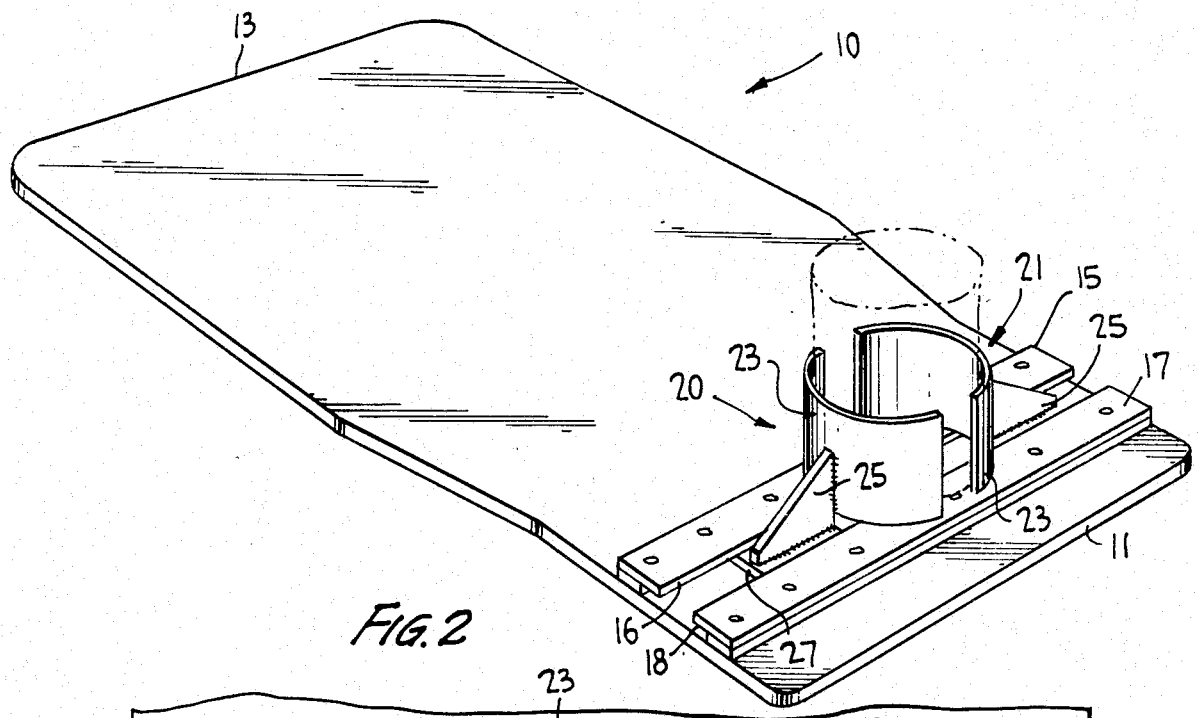
FIG. 2
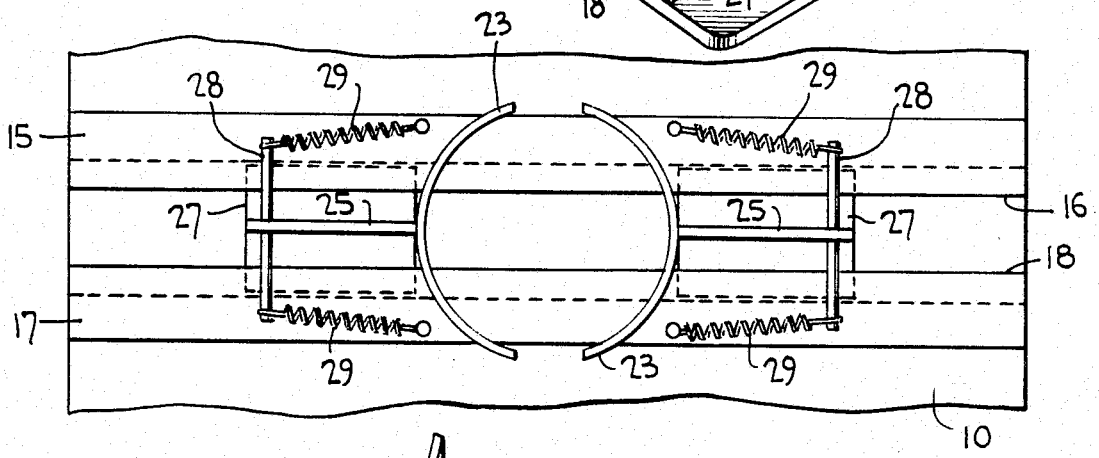
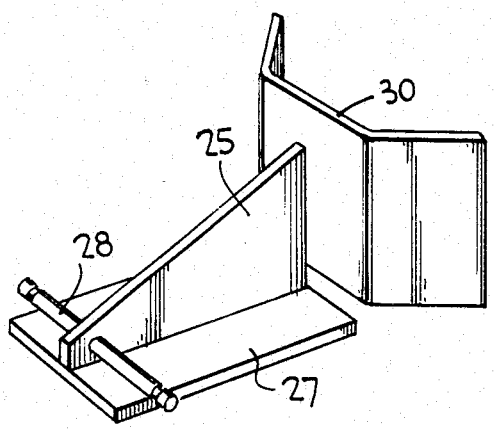
FIG. 3

METHOD AND APPARATUS FOR SUPPORTING LOGS AND THE LIKE

BACKGROUND OF THE INVENTION

1. Technical Field

The present invention relates to a method and apparatus for facilitating splitting of logs or pieces of cord wood. More particularly, the invention relates to a method and apparatus for supporting a log or piece of cord wood in an upright position so that it can be split without falling over or otherwise moving when struck by an axe or sledge.

2. The Prior Art

Logs or cord wood pieces are generally split by standing the log upright, (i.e., on end and striking the log with an axe, or with a sledge hammer, or with a maul through a wedge. An unsupported log tends to fall over or otherwise move from the blows, necessitating repetitive repositioning of the log.

A prior art attempt at stabilizing a log or piece of cord wood to be split is described in U.S. Pat. No. 3,169,760 (Field). Field discloses a base in the form of a triangular frame to which support arms are pivotally engaged at the base apices. The support arms pivot in vertical planes toward a central exis along which a log is positioned upright between the distal ends of the support arms. The pivot connection for the support arms to the base includes a frictional engagement so that the support arms can be maintained in different pivot positions.

The Field device prevents the struck log or piece of cord wood from falling over between sledge blows in most instances. However, there is a tendency for the entire base member to move in response to the shock of sledge blows applied to the unit through the log. A user, therefore, must move with the unit after each blow and must reset himself or herself before initiating the next blow. In addition, the area of contact with the log consists of the narrow edges of the three support arms. This constitutes three short lineal contacts which do not prevent the struck log from twisting in a pitching motion when struck and becoming disengaged from the support arm edges.

OBJECTS AND SUMMARY OF THE INVENTION

It is, therefore, an object of the present invention to provide a method and apparatus for supporting a log or piece of cord wood to be split whereby the log is positionally stabilized and prevented from tipping or otherwise moving in response to blows from a sledge or the like.

It is another object of the present invention to provide an apparatus for holding a log or piece of cord wood, which apparatus positionally stabilizes a log being split and which apparatus can itself be positionally stabilized during log splitting.

In accordance with the present invention, a log is supported upright between two support members, at least one of which is mounted for movement toward and away from the other on a base member. The base member is sufficiently large to permit a user to stand thereon and stabilize it with his or her weight while swinging a sledge or axe to split the log. The stabilized base member thereby remains stationary when the log is struck and renders the splitting process simpler and more convenient. The support members have generally concave surfaces which are vertically elongated to provide a relatively large contact area with the supported log. This relatively large contact area prevents pitching or other movements of the log within the support members. The support members are prevented from inadvertent movement by spring-biasing them toward one another, frictionally engaging one or both support members in tracks secured to the base member, locking one or both support members in place, and/or detenting one or both support members in tracks.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings, wherein:

FIG. 1 is a view in perspective of one embodiment of the log suport apparatus of the present invention;

FIG. 2 is a partial top view in plan of a second embodiment of the log support apparatus of the present invention;

FIG. 3 is a view in perspective of a modification of a support member portion of the log support apparatus illustrated in FIGS. 1 and 2;

DESCRIPTION OF THE PREFERRED EMBODIMENTS

Figure 4:
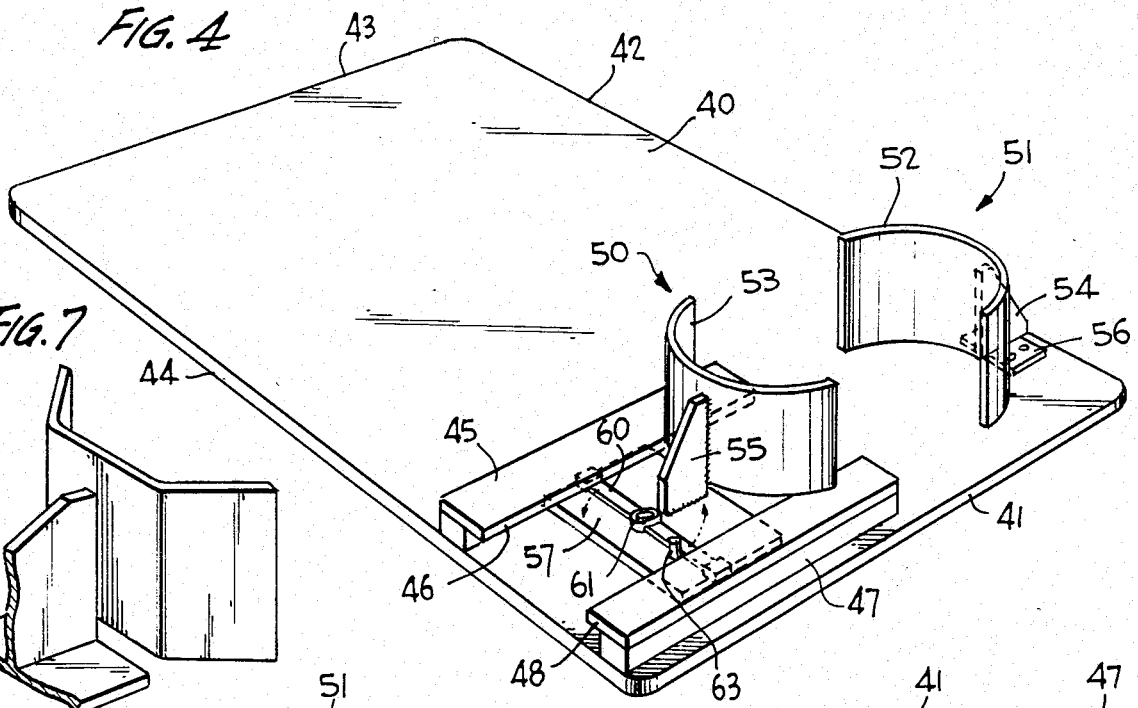
FIG. 4 is a view in perspective of a third embodiment of the log support apparatus of the present invention.

Referring to FIG. 1 of the accompanying drawings in greater detail, a base member 10 takes the form of a flat plastic or metal plate or wooden board having a forward edge 11 and a rear edge 13. In the preferred embodiment, as illustrated, the plate or board 10 is generally rectangular in shape with forward and rear sections having parallel sides. The forward and rear sections are spaced by an intermediate section having sides which diverge slightly in a rearward direction. The rear section is, therefore, slightly wider than the forward section. The front-to-rear length of the plate or board 10 is sufficient to permit a user to stand on the rear section and swing an axe or sledge so as to strike a log supported in an upright position atop the forward section. Typically, this length is on the order of five feet but may be shorter or longer.

A pair of track members 15, 17 are secured to the top surface of base member 10 and extend in parallel spaced relation transversely across the entire width of the forward section of the plate or board. The track members include respective lip members 16, 18 which overhang the top surface of the base member 10. The lip members define respective transversely-extending elongated slots which face one another across the gap between the track members 15, 17. In the illustrated embodiment, lips 16 and 18 are defined by fabricating each track member from two elongated strips secured one atop the other, with the upper strip being wider and, therefore, overhanging the lower strip to define the lip. Of course, each track member can be formed as an integral unit if desired.

Two support members 20, 21 each include a support element 23 in the form of a horizontally arcuate plate. The arc subtended by the plate 23 is greater than 90° and preferably approaches 180°. A bracket 25 takes the form of a generally right angle triangular member having one right angle edge secured vertically along the rear convex side of the arcuate plate 23 at a point substantially at or near the arcuate center of the plate. The other right angle edge of bracket 25 is secured to a support member base flange 27 which takes the form of a rectangular plate. Rectangular plate 27 has a length which is substantially shorter than the length of track members 15, 17. The width of plate 27 is greater than the spacing between lip members 16 and 18 and less than the spacing between track members 15, 17 along the upper surface of board 10. Flange 27 has a thickness which is substantially equal to the height of the slots defined between the top surface of base member 10 and the lip members 16, 18. The flange is, thus, slidable between track members 15, 17 and frictionally engaged against the base member 10 by lips 16, 18 to prevent inadvertent movement of the flange. The two support members are inserted into opposite ends of the track arrangement with the horizontally concave surfaces of arcuate members 23 facing one another. The bottom edges of the arcuate members 23 are disposed above flange 27 by a distance greater than the thickness of lips 16, 18 in order that the arcuate members clear the track members.

It is important that the height (i.e., vertical dimension) of arcuate plates 23 be sufficient to support a log or piece of cord wood disposed therebetween. Moreover, the height of these plates should be sufficient to provide a relatively large area of contact between the concave surfaces of elements 23 and the supported log so that the log cannot twist off axis when struck from above by an axe or sledge. To achieve these desired results, a height of at least six inches, and preferably greater, is required. In addition, the radius of curvature of the horizontally concave surfaces of members 23 should be just slightly greater than the radius of a typical log to be split. Of course, log radii vary and this dimension can only be made approximate to the average log.

In operation, to insert a log to be supported for splitting, support members 20, 21 are pulled apart and the log is placed upright therebetween on track members 15, 17. The support members 20, 21 are then pushed toward one another until firm contact is made between the upright log and the two concave surfaces of members 23. The user then positions himself or herself by standing on the rear section of the base 10. The user then swings an axe or sledge in a conventional manner to split the supported log. The log cannot fall over when so struck because it is supported about a considerable portion of its circumference and length by the concave surfaces of elements 23. The same support prevents the log from twisting or pitching off axis to excape the support members. In addition, the support members 20, 21 cannot move relative to the user because the support members are secured to base member 10 which, in turn, is positionally stabilized by the weight of the user standing thereon.

While the frictional engagement of flange 27 between base 10 and the lips 16, 18 serves to prevent inadvertent relative movement of support members 16, 18 in use, alternative means for achieving this result may be employed. For example, as illustrated in FIG. 2, the support members may be biased toward one another by means of springs or the like. Specifically, each support member 20, 21 may additionally be provided with a horizontally extending rod 28 secured to and extending through bracket 25. Each end of rod 28 has one end of a different spring 29 secured thereto. The other end of each spring is secured to a track member 15, 17 or to base member 10 so as to urge the two support members toward one another. Alternatively, springs may be provided around the outside of member 23 and secured to the support members only so as to urge the members toward one another.

Still other means for preventing inadvertent relative movement of the support members in use can take the form of a detent arrangement wherein lip members 16, 18 are provided with a linear array of through holes which can be selectively aligned with a respective pair of holes disposed in flange 27 on opposite sides of bracket 25. A pin or dowel is then inserted through the one hole in each array which is aligned with a hole in the flange 27 to secure the relative positioning of the support members 20, 21.

Other variations in the configuration of the components of the apparatus can be made. For example, the base member need not be generally rectangular, but instead, can be T-shaped (with a stem serving to support the user and the cross-bar supporting the tracks), oval, polygonal, etc. The important point here is not the shape of the base, but only that the user be able to stand on it in order to positionally stabilize the entire apparatus in use. In addition, the support members need not be movable along tracks as such; instead, the support members can be mounted for relative movement toward or away from one another by any means.

The support surfaces of the support elements themselves need not be arcuate; rather, they need only be generally concave. For example, plate 30 in the support member illustrated in FIG. 3 achieves general concavity in the support surface by providing plural planar surfaces joined at obtuse angles to approximate an arcuate configuration. It should further be noted that the support elements 23 need not be plates as such, but may be blocks or other solid sturctures having generally concave surfaces provided and oriented so that the generally concave surfaces of the two support members face one another.

Figure 5:
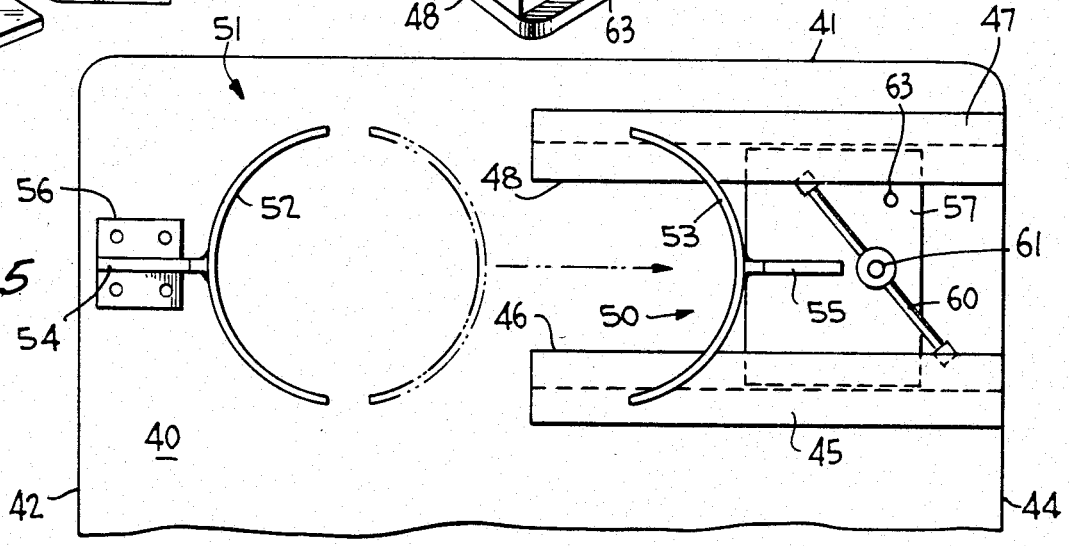
FIG. 5 is a view in plan of the embodiment of FIG. 4 showing the support members open.
Figure 6:
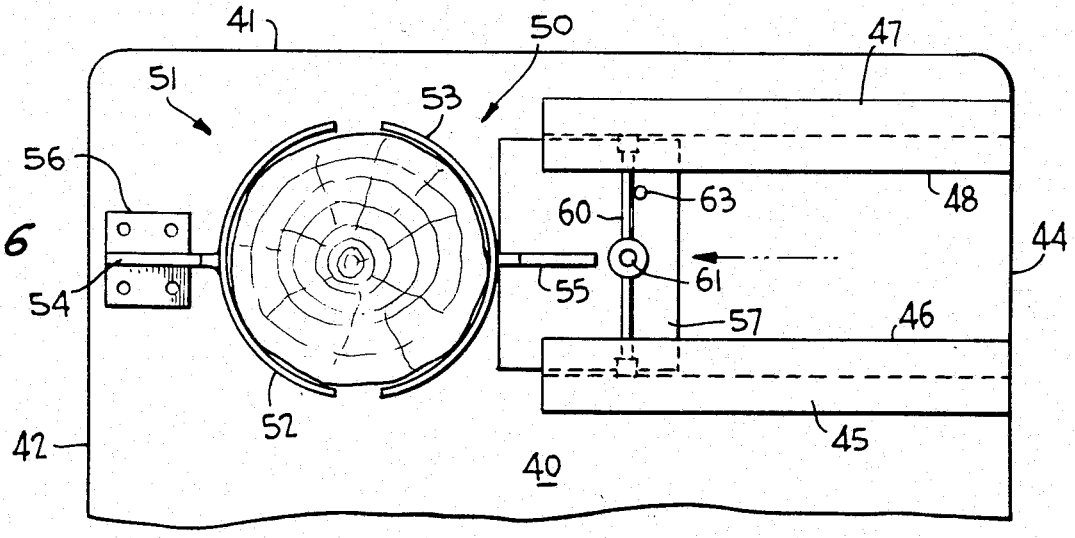
FIG. 6 is a view in plan of the embodiment of FIG. 4 showing the support members closed about a log.

Another embodiment of the present invention is illustrated in FIGS. 4, 5 and 6 to which specific reference is now made. A base member 40 takes the form of a flat plate or board which can be made considerably narrower than the plate or board 10 of FIG. 1. Base member 40 has a forward edge 41, a rear edge 43 longitudinally-extending edges 42, 44, and is of generally rectangular shape. Base member 40 has no tapered intermediate section of the type present in board 10, this tapered intermediate section being a design consideration and not a part of the present invention. The front-to-rear length of the base member 40 is sufficient to permit a user to stand on the rear section and swing an axe or sledge so as to strike a log supported in an upright position atop the forward section. Typically, this length is on the order of five feet, more or less.

A pair of track members 45, 47 are secured to the top surface of base member 40 and extend in parallel spaced relation transversely across a little more than half the width of the forward section of the board from longitudinal edge 44. The track members 45, 47 include respective lip members 46, 48 which overhang the top surface of the base member. The lip members define respective transversely-extending elongated slots which face one another across the gap between the track members 45, 47. In the illustrated embodiment, lips 46 and 48 are defined by fabricating each track member from two elongated strips secured one atop the other, with the upper strip being wider and, therefore, overhanging the lower strip to define the lip. Of course, each track member can be formed as an integral unit if desired. Unlike track members 15, 17 of the embodiment of FIG. 1, track members 45, 47 do not extend entirely across board member 10 for reasons that will become clear from the following description.

A first support member 50 includes a support element 53 in the form of an arcuate plate. The arc subtended by the plate 53 is greater than 90° and preferably approaches 180°. A bracket 55 takes the form of a generally right angle truncated triangular member having one right angle edge secured vertically along the rear convex side of the arcuate plate 53 at a point substantially at or near the arcuate center of the plate. The other right angle edge of bracket 55 is horizontally disposed and secured to a support member base flange or slide 57 which takes the form of a rectangular plate. Rectangular plate 53 fits longitudinally between track members 45, 47 and has a length which is substantially shorter than the length of the track members. The width of plate 57 is greater than the spacing between lip members 46, 48 and less than the spacing between track members 45, 47 along the top surface of board 40. Slide 57 has a thickness or depth which is substantially equal to the height of the slots defined between the top surface of board 40 and the lip members 46, 48. The slide is, therefore, slidable along board 40 between track members 45, 47. A second support member 51 includes an arcuate support plate 52 and bracket 54 mutually arranged in a structure which is similar to arcuate plate 53 and bracket 55 of support member 50. However, support member 51 is not slidable and therefore does not include a flange or slide member corresponding to slide 57 of support member 51. Instead, the horizontal bottom edge of bracket 54 is secured to a horizontal mounting plate 56 which is fixedly secured to the top surface of board 40 at a location proximate longitudinally-extending edge 44 with the concave surface of plate 53. The movable support member 50 is thus movable in its track toward and away from fixed support member 51. It is important that track members 45, 47 extend sufficiently close to support member 51 to permit the plates 52 and 53 which extend forwardly of slide 57 and plate 56 to support the smallest diameter upright logs to be split.

It is also important that the height (i.e., vertical dimension) of arcuate plates 52, 53 be sufficient to support a log or piece of cord wood disposed therebetween. Moreover, the height of these plates should be sufficient to provide a relatively large area of contact between the facing concave surfaces of elements 52, 53 and the supported log so that the log cannot twist off axis when struck from above by an axe or sledge. To achieve these desired results, a height of at least six inches, and preferably eight or nine inches, is required.

A locking member 60, in the form of an elongated bar, is pivotably secured to a vertically-extending pivot pin 61 which is at one end to the top surface of slide 57. Locking bar 60 is pivotable in a horizontal and is disposed at a height sufficiently low to permit its ends to pass under respective lip members 46, 48 when the bar 61 is positioned perpendicular to the direction of motion of slide 57 in the track members 45, 47. The length of bar 60 is selected to permit the ends of the bar to firmly contact respective opposed side walls of the tracks beneath lip members 46, 48 so as to positively fix the position of slide 57 and support member 50 at various locations along the path defined by track members 45, 47. For this purpose, the ends of bar 61 are provided with caps 62 which are made of rubber, plastic or other relatively high friction material so as to permit positive engagement of the locking bar in the tracks when the locking bar is disposed perpendicular to the direction of slide motion. In the preferred embodiment, pivot pin 61 is disposed centrally between the track members 45, 47 so that equal lengths of locking bar 61 extend from that pin and contact respective track side walls in the locking position (shown in FIG. 6). It should be understood, however, that pivot pin 61 need not be centered. It should also be appreciated that the ends of locking bar 60 can be configured to lock against the mutually facing edges of lips 46, 48 rather than the track sidewalls as illustrated. In either case, it may be desirable to provide a stop member 63 to define a limit for pivotal movement of locking bar 60, which limit corresponds to the locked position of bar, as illustrated in FIG. 6. Specifically, stop member 63 may take the form of a block, pin, rod or other member secured to the top surface of slide 57 at a location such that it blocks pivotal movement of bar 60 beyond its locked position. This facilitates locking of the slide in place by a user who need only pivot bar 60, with his or her foot, in a clockwise direction until the bar is stopped by member 63. Unlocking merely requires movement of the bar in a counterclockwise direction.

In operation, to insert a log to be supported for splitting, movable support member 50 is pulled away from fixed support member 51 and the log is placed upright in contact with the concave side of fixed plate 52. Movable support member 51 is then pushed toward fixed member 51 until firm contact is made between the upright log and the concave sides of arcuate plates 52 and 53. The user then locks support member 50 in place by rotating locking bar 60 to its locked position, and positions himself or herself by standing on the rear section of the base 40. An axe or sledge can then be used in a conventional manner to split the supported log. The log cannot fall over when so struck because it is supported about a considerable portion of the circumference and length by the concave surfaces of support members 50, 51. The same support members prevent the log from twisting or pitching off axis to escape the support members. In addition, the support members 50, 51 cannot move relative to the user because support member 51 is fixedly secured to base member 40, movable support member 51 is secured by locking bar 60 to tracks 45, 47 which are secured to base member 40, and base member 40 is positionally stabilized by the weight of the user standing thereon.

Figure 7:
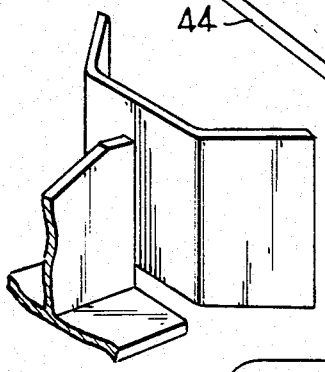
FIG. 7 is a view in perspective of a modification of the support member portion of the embodiment of FIG. 4.

The support surfaces of the support elements themselves need not be arcuate; rather, they need only be generally concave. For example, plate 70 in the support member illustrated in FIG. 7 achieves general concavity in the support surface by providing plural planar surfaces joined at the obtuse angles to approximate an arcuate configuration. It should further be noted that the support elements 52, 53 need not be plates as such, but may be blocks or other solid structures having generally concave surfaces provided and oriented so that the generally concave surfaces of the two support members face one another.

While I have described and illustrated plural specific embodiments of my invention, it will be clear that variations of the details of construction which I specifically illustrated and described may be resorted to without departing from the true spirit and scope of the invention as defined in the appended claims.

What is claimed is:

1. Apparatus for supporting a log in upright position to permit the log to be longitudinally split, said apparatus comprising:

a base member having a top surface which is substantially horizontal in use;

a pair of support members; and mounting means mounting said support members on said top surface of said base member for relative movement of said support members in one horizontal dimension toward and away from one another to permit a log to be engaged between said support members, said mounting means including further means for preventing inadvertent relative movement between said support members when a log is supported therebetween;

wherein said base member is sufficiently long in a second horizontal dimension perpendicular to the relative movement of said support members to permit a user of said apparatus to stand on said top surface and positionally stabilize said base member with the user's weight while sledging a log supported on end between said support members.

2. The apparatus according to claim 1 wherein said further means comprises means for frictionally engaging said support members against said base member.

3. The apparatus according to claim 2 wherein said mounting means comprises:

a track assembly secured to said top surface and extending in said one dimension; and flange means secured to said support members and adapted to fit and be slidable in said track assembly.

4. The apparatus according to claim 3 wherein said track assembly includes a pair of elongated track members secured to said top surface and extending along said one dimension in spaced parallel relation, each track member having an overhanging lip spaced from said top surface to define an elongated space between a lip and the top surface, the lips of each pair of track members extending toward one another, and wherein said flange means includes a plate which extends tranversely under the lips of both track members to be vertically retained against said top surface by said lips for slidable movement along said elongated spaces.

5. The apparatus according to claim 4 wherein said further means comprises frictional engagement between said flange member and said top surface and between said flange member and the underside of said lips due to a snug fit of said flange member in said elongated spaces.

6. The apparatus according to claim 1 wherein said further means comprises resilient means for biasing said support members toward one another.

7. The apparatus according to claim 6 wherein said resilient means includes at least one spring.

8. The apparatus according to claim 1 wherein said support members each include a member having a horizontally-extending generally concave surface facing the other support members such that the concave surfaces of the two support members at least partially surround a log inserted on end therebetween.

9. The apparatus according to claim 8 wherein said generally concave surface is arcuate.

10. The apparatus according to claim 8 wherein said generally concave surface includes plural intersecting planar sections.

11. The apparatus according to claim 8 wherein said concave surface is continuous in its concavity over an arc of at least 90°.

12. The apparatus according to claim 8 wherein said generally concave surface extends at least six inches vertically and transversely of the surface concavity.

13. The apparatus according to claim 1 wherein each support member has a continuous vertical dimension of at least eight inches.

14. The apparatus according to claim 1 wherein said mounting means comprises:

a track assembly secured to the top surface of said base member and extending in said one dimension;

slide means secured to one of said support members and adapted to fit and be slidable in said track assembly; and means securing the other of said support members in a fixed position relative to said base member.

15. The apparatus according to claim 14 wherein said further means comprises:

pivotable means secured to said slide means for pivoting thereon to selectively frictionally engage said track assembly.

16. The apparatus according to claim 1 wherein said further means comprises movable means secured to at least one of said support members for selectively fixing said one support member in place relative to said base member.

17. The apparatus according to claim 1 wherein said base member is generally rectangular in configuration.

18. The method of supporting a log or piece of cord wood to be split comprising the steps of:

supporting the log upright on a base member between two supports which are mutually re-positionable toward and away from one another; and positionally stabilizing the base member by standing thereon while splitting the supported log with a sledging action.

19. The method according to claim 18 further comprising the step of:

fixedly positioning said two supports with respect to said base member while splitting the supported log to prevent inadvetent separation of the supports by said sledging action.

20. The method according to claim 18 further comprising the step of:

preventing inadverting inadvertent separation of said supports during said sledging action by resiliently biasing at least one of said two supports into engagement with the supported log.

* * * * *